US006415724B1

(12) United States Patent
Albrecht et al.

(10) Patent No.: US 6,415,724 B1
(45) Date of Patent: Jul. 9, 2002

(54) WATER-JACKETED, HIGH-TEMPERATURE, STRETCHER-ACCESSIBLE DOOR FOR A BOILER

(75) Inventors: Melvin J. Albrecht, Homeworth; James P. Aman, Canton; James L. Barkan, Massillon; Doiuglas J. DeVault, Rootstown, all of OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 09/234,687

(22) Filed: Jan. 21, 1999

(51) Int. Cl.[7] ..... F23M 7/04

(52) U.S. Cl. ..... 110/180; 110/173 R; 122/498; 165/168; 432/237

(58) Field of Search ..... 110/180, 172, 110/173 R, 173 B, 173 C, 182; 122/498; 432/237; 165/168, 169

(56) References Cited

U.S. PATENT DOCUMENTS

| | | | | | |
|---|---|---|---|---|---|
| 289,859 | A | * | 12/1883 | Roberts | 165/168 |
| 1,168,647 | A | * | 1/1916 | Knox | 122/498 X |
| 2,259,900 | A | * | 10/1941 | Loxterman | 122/498 |
| 2,355,142 | A | * | 8/1944 | Bulmer | 122/498 |
| 2,360,855 | A | * | 10/1944 | Dow et al. | 110/173 R |
| 2,391,010 | A | * | 12/1945 | Dalin | 110/180 X |
| 2,534,747 | A | * | 12/1950 | Wilson et al. | 122/498 |
| 2,602,646 | A | * | 7/1952 | Colonna | 165/169 |
| 2,822,788 | A | * | 2/1958 | Braun | 122/498 |
| 2,864,345 | A | * | 12/1958 | Reighart | 122/498 |
| 3,155,080 | A | * | 11/1964 | Braun | 110/180 X |
| 4,182,610 | A | * | 1/1980 | Mizuno et al. | 432/237 |
| 4,808,205 | A | * | 2/1989 | Hughes et al. | 432/237 X |
| 4,903,640 | A | * | 2/1990 | Howard | 432/237 X |
| 5,158,043 | A | * | 10/1992 | Emsbo | 122/498 |

FOREIGN PATENT DOCUMENTS

| | | | | |
|---|---|---|---|---|
| CA | 733769 | * | 5/1966 | 122/498 |
| SU | 861664/22-2 | * | 7/1966 | 122/498 |

* cited by examiner

*Primary Examiner*—Ljiljana Ciric
(74) *Attorney, Agent, or Firm*—Eric Marich

(57) ABSTRACT

An access door for a boiler or furnace has a water-cooled jacket mounted on a door panel frame for use in high temperature regions of furnaces and boilers. The door is large enough to permit a stretcher to pass through unobstructed. The water-cooled jacket has a series of baffles which direct water in a serpentine path through the jacket. Plant water, as opposed to boiler quality water, may be used to cool the door. A viewing port may be provided in the door as well.

6 Claims, 6 Drawing Sheets

WATER-JACKETED, HIGH-TEMPERATURE, STRETCHER-ACCESSIBLE DOOR FOR A BOILER

FIELD AND BACKGROUND OF THE INVENTION

1. Field of the Invention

The present invention relates generally to the field of industrial boilers and furnaces and in particular to a new and useful, high temp zone safety access door for steam generating boilers.

2. Description of the Related Art

Access doors to the interiors of steam generating boilers are used to enter a boiler for maintenance during downtimes in boiler operation. It is advantageous to place these doors at the level of the furnace or boiler floor. However, these regions of a furnace or boiler are often the hottest when combustion is taking place, since burners are positioned there for initial combustion.

Known access doors for furnaces and boilers have several drawbacks.

One prior door, originally sold by The Babcock & Wilcox Company, but no longer offered, was oval shaped and sized 15 inches by 21 inches. A cooling coil was sealed inside refractory material in the door. The coil covers only a fraction of the total area of the door, with refractory material occupying the remaining space. External hoses supplied boiler quality water to the cooling coil. Boiler-quality water is conventionally demineralized and deaerated to prevent corrosion of the metal tubes by contact with the high temperature water and steam. Even using boiler-quality water this door could not be used at extreme temperatures adjacent furnace and boiler burners for any length of time as the coil would tend to become overheated and/or blocked and reduce water flow and cooling capacity.

Another door currently produced by The Babcock & Wilcox Company is not water-cooled, but instead includes layers of refractory material and insulation. The door is a 22 inch diameter circular opening provided through a special break in the tube wall of a furnace or boiler. The door is intended to withstand temperatures between 2200° F. and 3100° F., however, it does not have a long service life at the extreme furnace and boiler temperatures found adjacent the burner positions.

These doors lack the ability to use untreated plant water to cool the door, as well as longevity in the hottest regions of the boiler or furnace, which may be between 2600° F. and 3300° F.

SUMMARY OF THE INVENTION

It is an object of the present invention to provide a safety access door for industrial furnaces and boilers which is easy to maintain and efficient to use and produce.

It is a further object of the invention to provide an access door for a furnace or boiler which is sufficiently wide to permit medical equipment such as a stretcher to pass through unobstructed.

Yet another object of the invention is to provide an access door which can withstand extreme furnace and boiler temperatures of between 2600° F. and 3300° F. in the regions adjacent burner zones.

Accordingly, an access door having a water-cooled jacket mounted on a door panel frame in a furnace or boiler wall is provided for use in high temperature regions of furnaces and boilers. The door is circular, preferably, with a diameter sufficiently large enough to permit a stretcher to pass through unobstructed, however, oval rectangular or square doors could be employed. The water-cooled jacket has a series of baffles which direct water in a serpentine path through the jacket. Plant water, as opposed to boiler quality water, may be used to cool the door. The jacket receives water from hoses connected to the top and bottom of the jacket at opposite ends of the serpentine path. Alternatively, multiple, separate flow paths for cooling water may be employed. A viewing port may be provided in the door as well.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
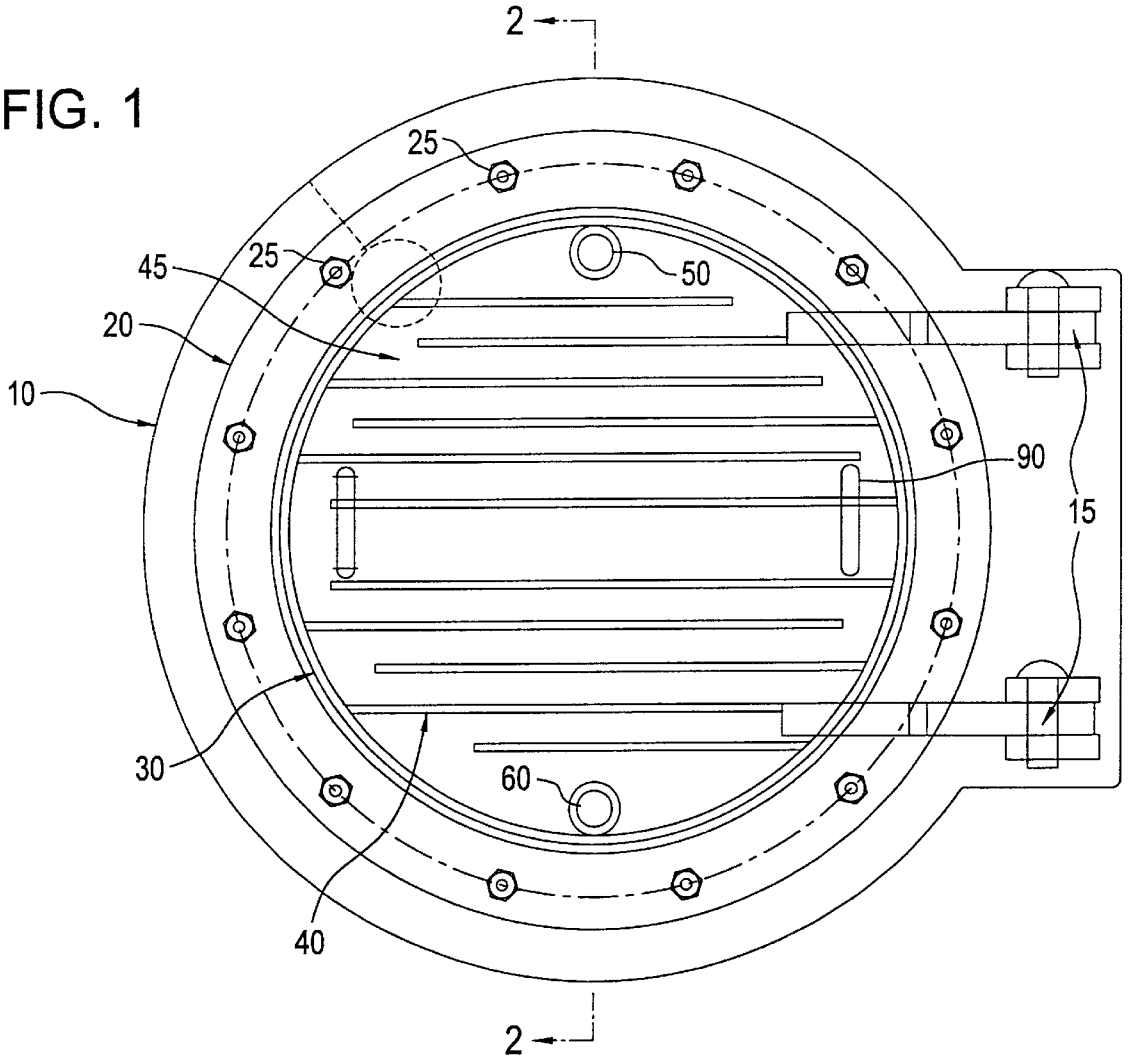
FIG. 1 is a front elevational view of an access door of the invention.
Figure 2:
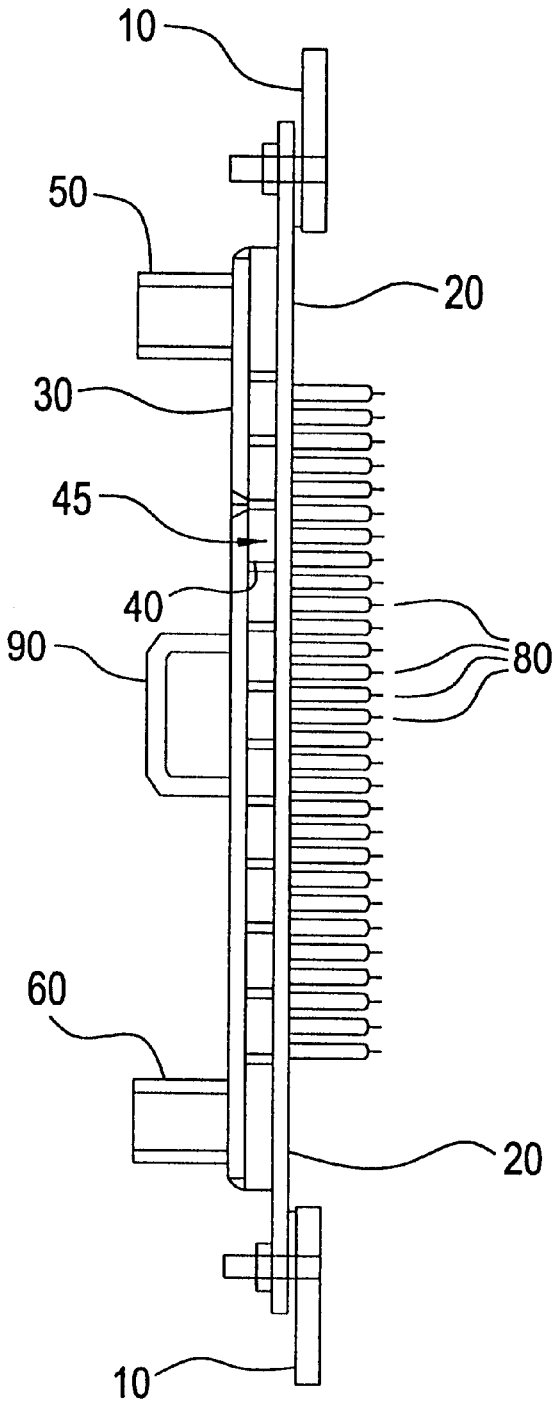
FIG. 2 is a side sectional view of the access door of FIG. 1 taken along line 2—2.
Figure 3:
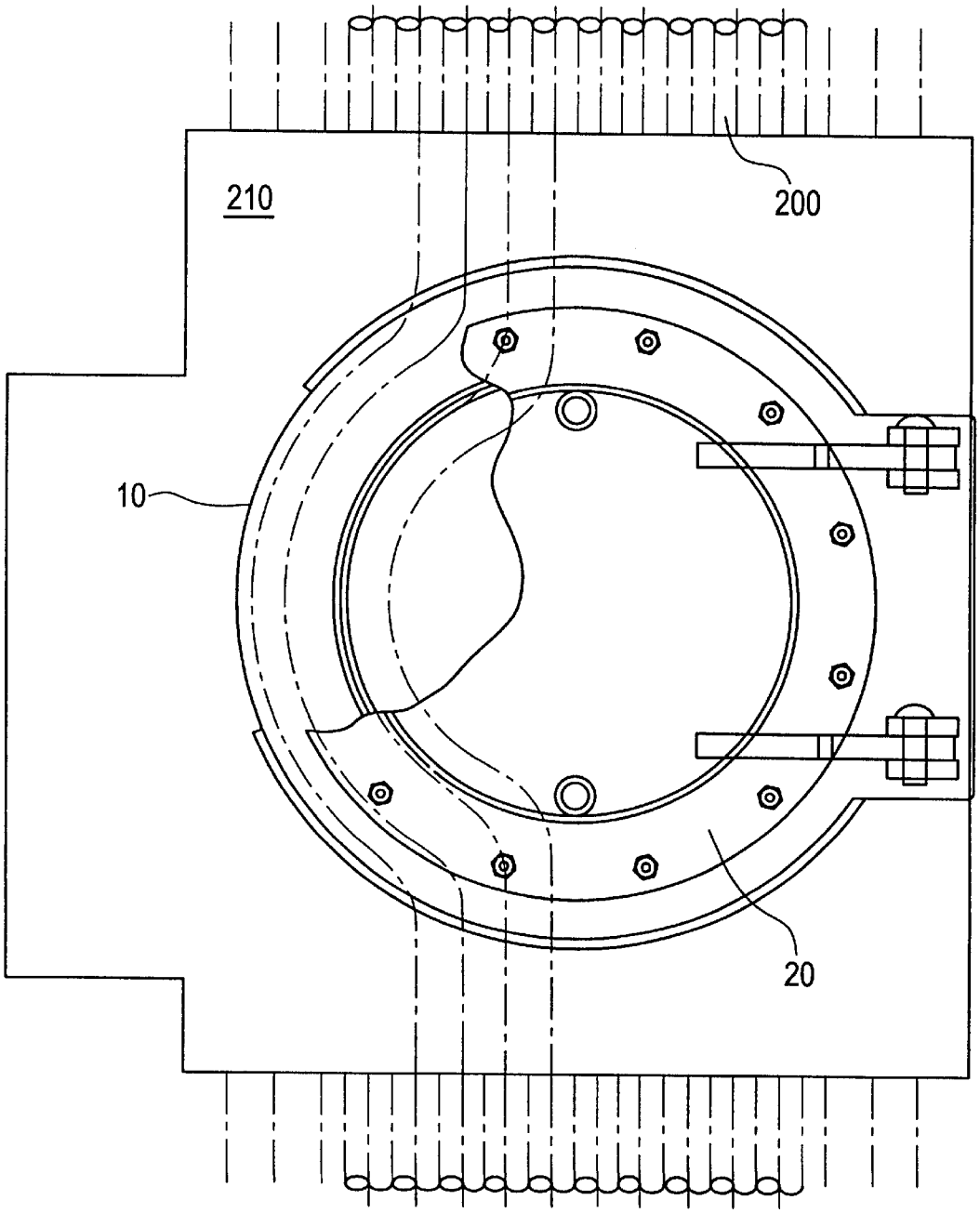
FIG. 3 is a front elevational view of a furnace wall with the access door of FIG. 1 mounted.

Referring now to the drawings, in which like reference numerals are used to refer to the same or similar elements, FIGS. 1 and 2 show a door frame 10 connected by a pair of hinges 15 to door 20. The door frame 10 is a circular ring with a large central opening. The edges of door 20 overlap frame 10. Bolts 25 may be used to hold the door 20 shut against frame 10. The frame 10 is secured to a furnace wall 210 (shown in FIG. 3) at an opening 220 (FIG. 4) in the furnace wall 210 and tubes 200.

Returning to FIG. 1, door 20 has a water jacket 30 mounted to the exterior of door 20. Water jacket 30 is a cylindrical shell which forms a chamber over the door 20. The water jacket 30 preferably has a diameter which is the same or slightly larger than the diameter of the opening 200 in the furnace wall 210. An inlet 60 and outlet 50 are provided diametrically opposed on the water jacket 30. The inlet 60 and outlet 50 extend outwardly from the water jacket 30 and can be connected between an external water supply 500 and drain 510.

Inside the water jacket 30, a series of baffles 40 are arranged to form a serpentine path 45 between the inlet 60 and outlet 50. The baffles 40 are spaced to allow a water volume flow through the serpentine path 45 in the water jacket 30 that will cool the door 20. The serpentine path 45 covers the entire area of the door 20 which is exposed on the furnace side to the high furnace temperatures. The coverage of the path 45 is unique in that it cools the entire area of the door which is subjected to high furnace temperatures on the opposite(furnace) side.

Handles 90 may be provided on the water jacket 30 to assist opening the door 20 when the bolts 25 or other latching means are removed.

Figure 4:
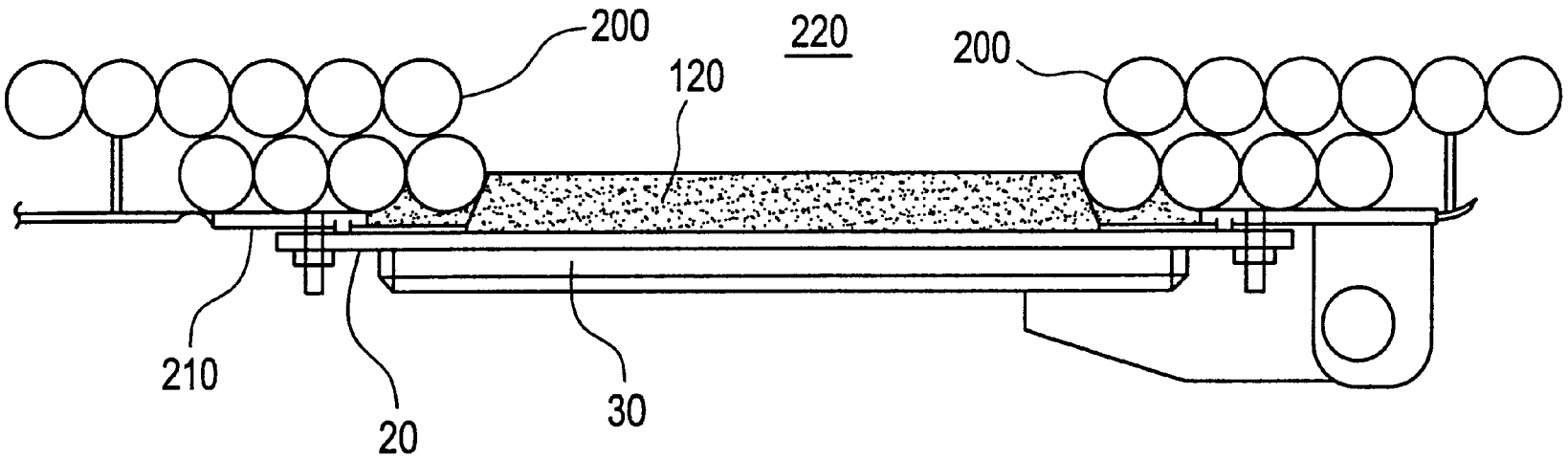
FIG. 4 is a top sectional view of the door and opening through the furnace or boiler wall of FIG. 3.

As seen in FIG. 2, heat transfer surfaces such as pins 80 are arranged on the furnace side of the door 20. The pin 80 pattern must be dense. A high temperature refractory 120 covers the pins 80 the furnace side surface of door 20, as shown in FIG. 4. The refractory 120 is rammed over the pins 80 to hold it in place on the door 20.

Figure 5:
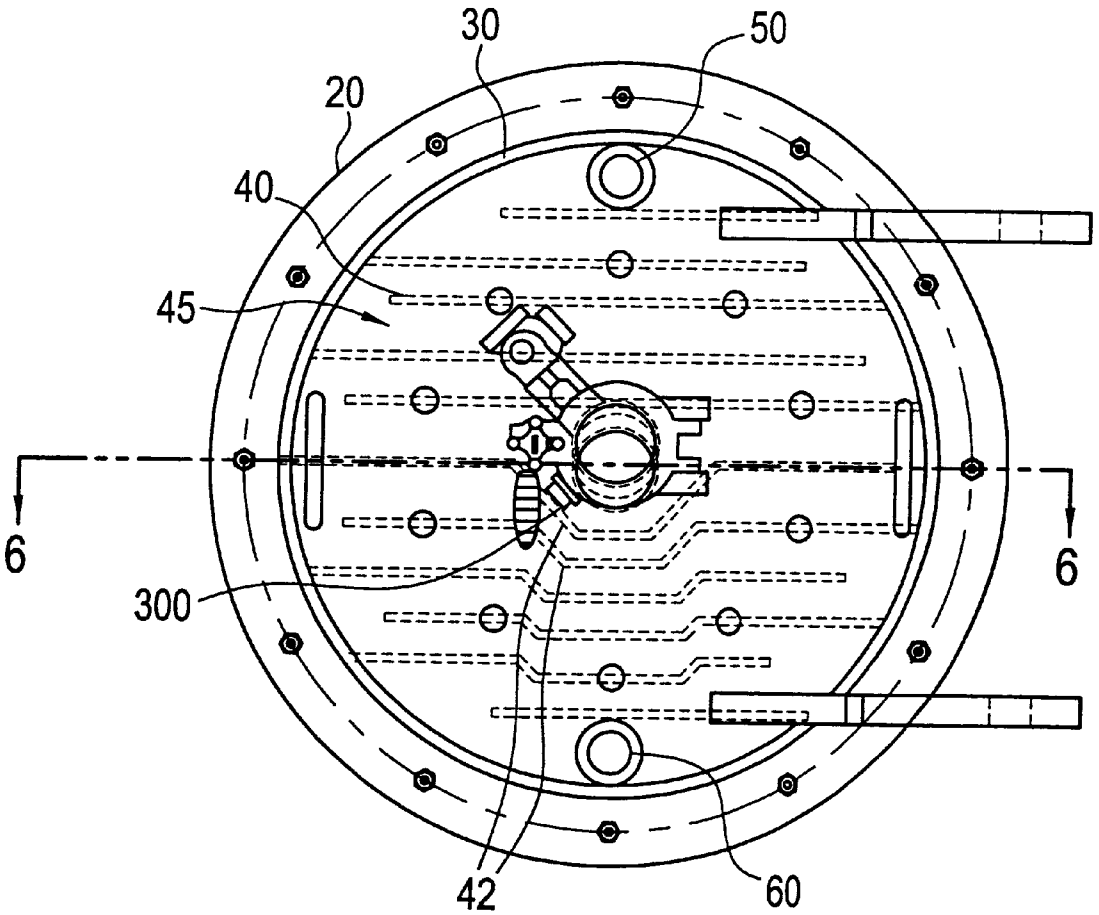
FIG. 5 is a front elevational view of a second embodiment of the access door of the invention.
Figure 6:
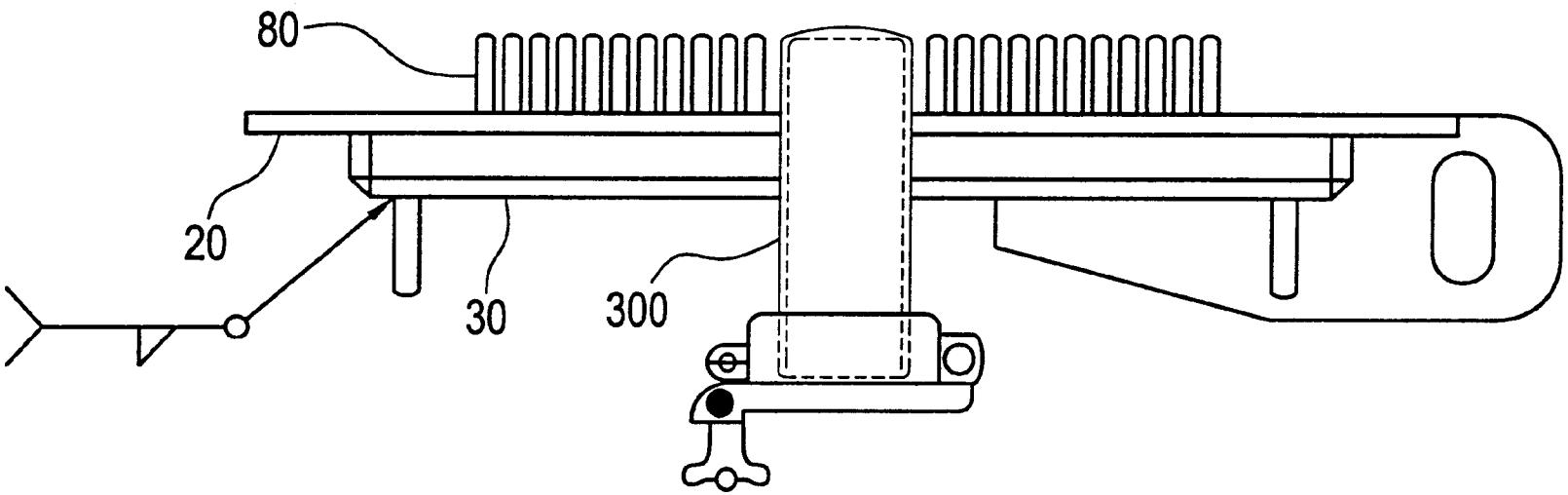
FIG. 6 is a top sectional view of the door of FIG. 5 taken along line 6—6.

In the embodiment shown in FIGS. 5 and 6, a viewing port 300 is provided in the door 20 through the water jacket 30. To accommodate the viewing port 300, some of the baffles 42 in the water jacket are bent. The water flow through the serpentine path 45 in the water jacket 30 is thereby allowed to cover substantially all of the area of the door 20 exposed to the furnace temperatures on the furnace side of the door 20. The viewing port 300 allows observation of the interior of the furnace or boiler during operation.

In each case, the serpentine path 45 through the water jacket 30 should be wide enough to permit a substantial water flow through the path 45. The water temperature exiting the water jacket 30 at the outlet 50 should not exceed 175° F. By keeping the outlet water temperature down, the quality of the water used to cool the door does not have to be as high as that used in the boiler tubes and other water tubes exposed to extremely high temperatures. Thus, plant water, as opposed to boiler water, can be used for the cooling water in the water jacket 30.

Further, in each embodiment shown, the door 20 is preferably at least 22" wide to accommodate medical and safety equipment, such as a stretcher for treating and assisting workers injured within the furnace or boiler confines during downtime maintenance. The door size may be modified for use with other boiler openings as well.

While a specific embodiment of the invention has been shown and described in detail to illustrate the application of the principles of the invention, it will be understood that the invention may be embodied otherwise without departing from such principles.

What is claimed is:

1. A boiler safety access door assembly for use in high temperature regions of a boiler or furnace for accessing an interior region of the boiler or furnace through a wall opening in a side of the boiler or furnace, the safety access door assembly comprising:

a door frame positioned around the wall opening and having a door opening sized to permit a stretcher to pass unobstructed therethrough;

a door panel pivotally connected to the door frame outside the boiler or furnace and having a panel interior side facing the boiler or furnace interior region and an opposite panel exterior side facing away from the boiler or furnace interior region; and, a water jacket on the panel exterior side having a water inlet, a water outlet, and a plurality of horizontally extending baffles defining a serpentine path for conveying water through the water jacket between the water inlet and water outlet over the panel exterior side, the serpentine path covering substantially all of an area of the panel exterior side corresponding to an area of the panel interior side, subjected to the temperatures of the interior region of the boiler or furnace.

2. The boiler safety access door assembly according to claim 1, further comprising means for supplying and removing water to and from the water jacket through the inlet and outlet, respectively.

3. The boiler safety access door assembly according to claim 2, wherein the inlet is adjacent a bottom edge of the water jacket and the outlet is adjacent a top edge of the water jacket.

4. The boiler safety access door assembly according to claim 3, further comprising a viewing port extending through the water jacket and the door panel, wherein some of the horizontally extending baffles are bent around the viewing port inside the water jacket such that the viewing port is unobstructed.

5. The boiler safety access door assembly according to claim 1, further comprising a viewing port extending through the water jacket and the door panel.

6. The boiler safety access door assembly according to claim 5, wherein some of the horizontally extending baffles are bent around the viewing port inside the water jacket such that the viewing port is unobstructed.

* * * * *